US007080417B2

(12) United States Patent
Jiang

(10) Patent No.: US 7,080,417 B2
(45) Date of Patent: Jul. 25, 2006

(54) FOLDABLE CHAIR FOR BATHROOM

(76) Inventor: Jin Shan Jiang, P.O. Box 63-298, Taichung, 406 (TW)

( * ) Notice: Subject to any disclaimer, the term of this patent is extended or adjusted under 35 U.S.C. 154(b) by 19 days.

(21) Appl. No.: 10/949,788

(22) Filed: Sep. 27, 2004

(65) Prior Publication Data

US 2006/0071510 A1 Apr. 6, 2006

(51) Int. Cl.
*A47C 9/06* (2006.01)

(52) U.S. Cl. ..... 4/578.1; 297/14; 297/339; 297/16.1; 297/335; 4/254

(58) Field of Classification Search ..... 297/14, 297/338, 339, 337, 331, 335, 16.1, 217.1; 248/240, 250, 235; 4/611, 254, 578.1; 108/47, 108/48, 42, 40
See application file for complete search history.

(56) References Cited

U.S. PATENT DOCUMENTS 1,712,704 A * 5/1929 Kiser ..... 248/240.1
4,460,215 A * 7/1984 Chamberlain et al. ..... 297/14
4,680,817 A * 7/1987 Sloan et al. ..... 4/663
4,723,493 A * 2/1988 Siani et al. ..... 108/134
4,927,107 A * 5/1990 Mateo Maria ..... 248/240.4
5,205,524 A * 4/1993 Cohen ..... 248/235
5,337,525 A * 8/1994 Zaccai et al. ..... 52/35
5,492,389 A * 2/1996 McClintock et al. ..... 297/14
5,819,670 A * 10/1998 O'Connor et al. ..... 108/48
6,026,752 A * 2/2000 Zachrai ..... 108/40
6,247,273 B1 * 6/2001 Nickel ..... 52/127.2
6,487,979 B1 * 12/2002 Ash et al. ..... 108/44
6,643,865 B1 * 11/2003 Bork et al. ..... 4/664
6,789,494 B1 * 9/2004 Neese et al. ..... 114/343
6,843,526 B1 * 1/2005 Honda et al. ..... 297/14
6,846,044 B1 * 1/2005 Moffa et al. ..... 297/452.39

* cited by examiner

*Primary Examiner*—Peter M. Cuomo
*Assistant Examiner*—Erika Garrett

(57) ABSTRACT

A chair includes a support having one or more vertical rails to slidably receive one or more brackets, each bracket includes an opening formed between two ears, a seat plate includes one or more cams disposed in the opening of the bracket and rotatably secured to the ears of the bracket with a shaft, to allow the seat plate to be rotated relative to the bracket and the support. The cam may engage with the rail to support the seat plate in a folding position when the seat plate is parallel to the support, and may also to engage with the rail to support the seat plate in an open and working position when the seat plate is perpendicular to the support.

11 Claims, 4 Drawing Sheets

FOLDABLE CHAIR FOR BATHROOM

BACKGROUND OF THE INVENTION

1. Field of the Invention

The present invention relates to a chair, and more particularly to a chair for being used in a bathroom and having a foldable structure for allowing the chair to be easily folded to a compact storing or folded structure.

2. Description of the Prior Art

Typically, bathrooms of house buildings comprise a tiny or compact space having no additional or spare space to receive chairs or the like. In addition, the bathrooms of the house buildings normally comprise a slippery floor that people may not stably or safely stand thereon, and that people may have a good chance to have a fall.

Accordingly, the bathrooms of the house buildings have become a dangerous place where children, elders, patient, particularly the paralytic patients, etc. may not stably or safely stand thereon.

For allowing the children, the elders, the patient, particularly the paralytic patients, etc. to stably or safely stand on the floor of the bathrooms of the house buildings, one or more chairs may have to be moved into the bathrooms when the users are required to sit on, and may then have to be removed from the bathrooms when the users have taken bath.

However, it will be inconvenient and time consuming to move the chairs into the bathrooms, and then to remove the chairs from the bathrooms. In addition, the chairs are normally freely disposed on the ground and may also be easily moved relative to the ground, such that the users may also have a good chance to fall off the chairs, and may also have a good chance to be hurt.

The present invention has arisen to mitigate and/or obviate the afore-described disadvantages of the conventional chairs for being used in bathrooms.

SUMMARY OF THE INVENTION

The primary objective of the present invention is to provide a chair for being used in a bathroom and having a foldable structure for allowing the chair to be easily folded to a compact storing or folded structure.

In accordance with one aspect of the invention, there is provided a chair for bathroom comprising a support for securing to a wall of the bathroom, the support including at least one rail vertically disposed thereon, at least one bracket including a chamber formed therein to slidably receive the rail, and to allow the bracket to slide up and down along the rail, each of the bracket including an opening formed therein and communicating with the chamber 21 thereof, and defined between two ears, a seat plate including at least one cam provided thereon and disposed between the ears and in the opening of the bracket, the cam including an aperture formed therein, and a shaft engaged through the ears and the aperture of the cam, to rotatably secure the cam to the ears of the bracket with the shaft, and to allow the seat plate to be rotated relative to the bracket and the support. The cam is arranged to engage with the rail, and to support the seat plate in a folding and storing position when the seat plate is rotated relative to the rail to a position parallel to the support, and the cam may also be arranged to engage with the rail, and to support the seat plate in an open and working position when the seat plate is rotated relative to the rail to a position perpendicular to the support.

The support includes two bars for securing to the wall of the bathroom, and the rail is vertically secured between the bars. Each of the bars includes at least one frame provided thereon, and the rail includes upper and lower portions engaged into the frame and secured to the frame of the bars.

The rail includes a hollow bore formed therein, and includes a beam disposed and engaged into the hollow bore of the rail, to reinforce the rail, and to increase a bending strength of the rail.

The beam is engaged with an inner peripheral surface of the rail, to reinforce the rail. The beam includes a triangular cross section having a great bending strength. The rail preferably includes an oval cross section. The seat plate includes at least one stay secured thereto, and having the cam extended from the stay.

The bracket includes a first recess formed therein, and the cam includes a protrusion extended therefrom and engageable with the first recess of the bracket, and to anchor the seat plate to the support in the open and working position relative to the support.

The bracket includes a second recess formed therein and inclined relative to the first recess thereof, and the protrusion of the cam is engageable with the second recess of the bracket, and to anchor the seat plate to the support in the folding and storing position relative to the support.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
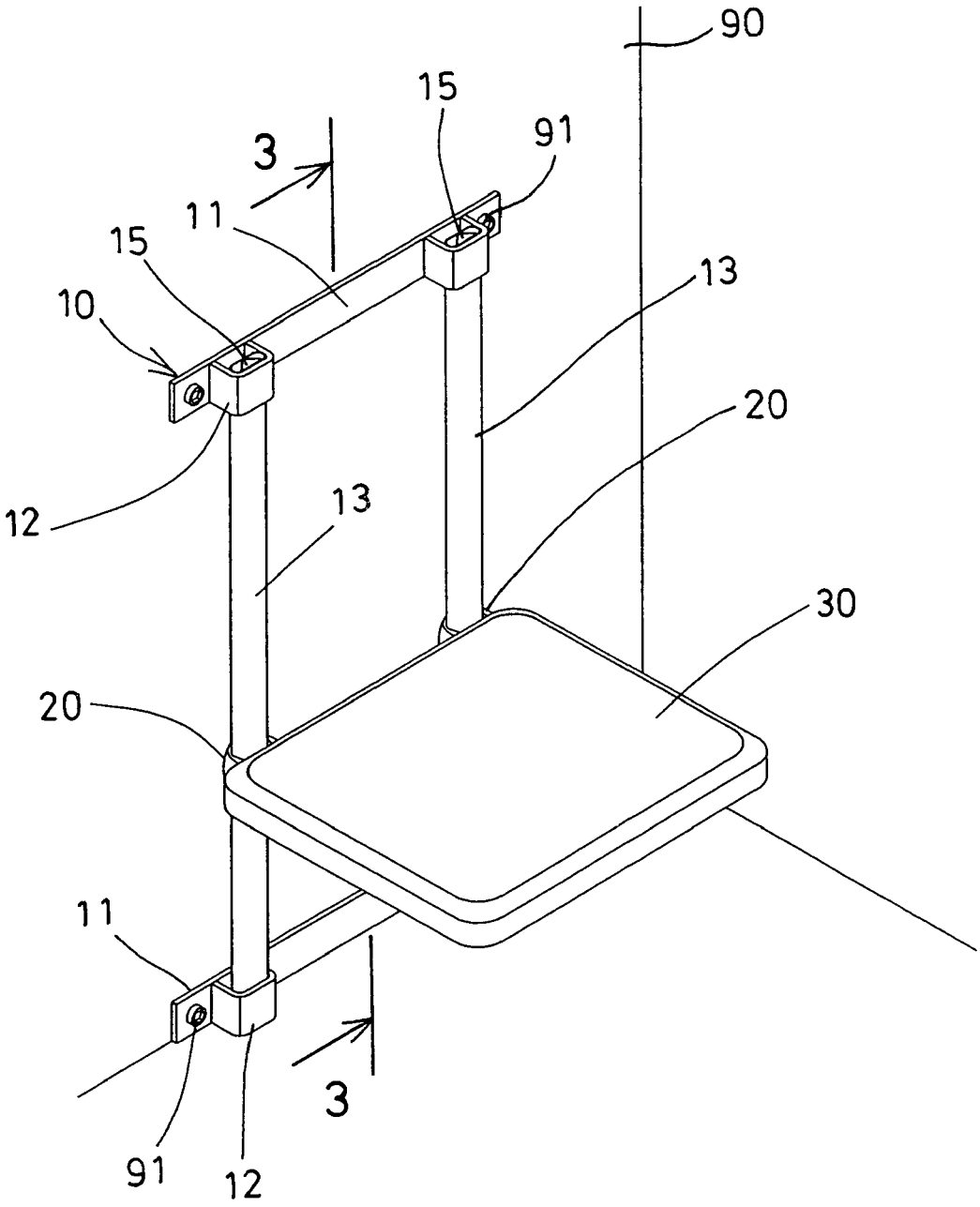
FIG. 1 is a perspective view of a chair for bathroom in accordance with the present invention.
Figure 2:
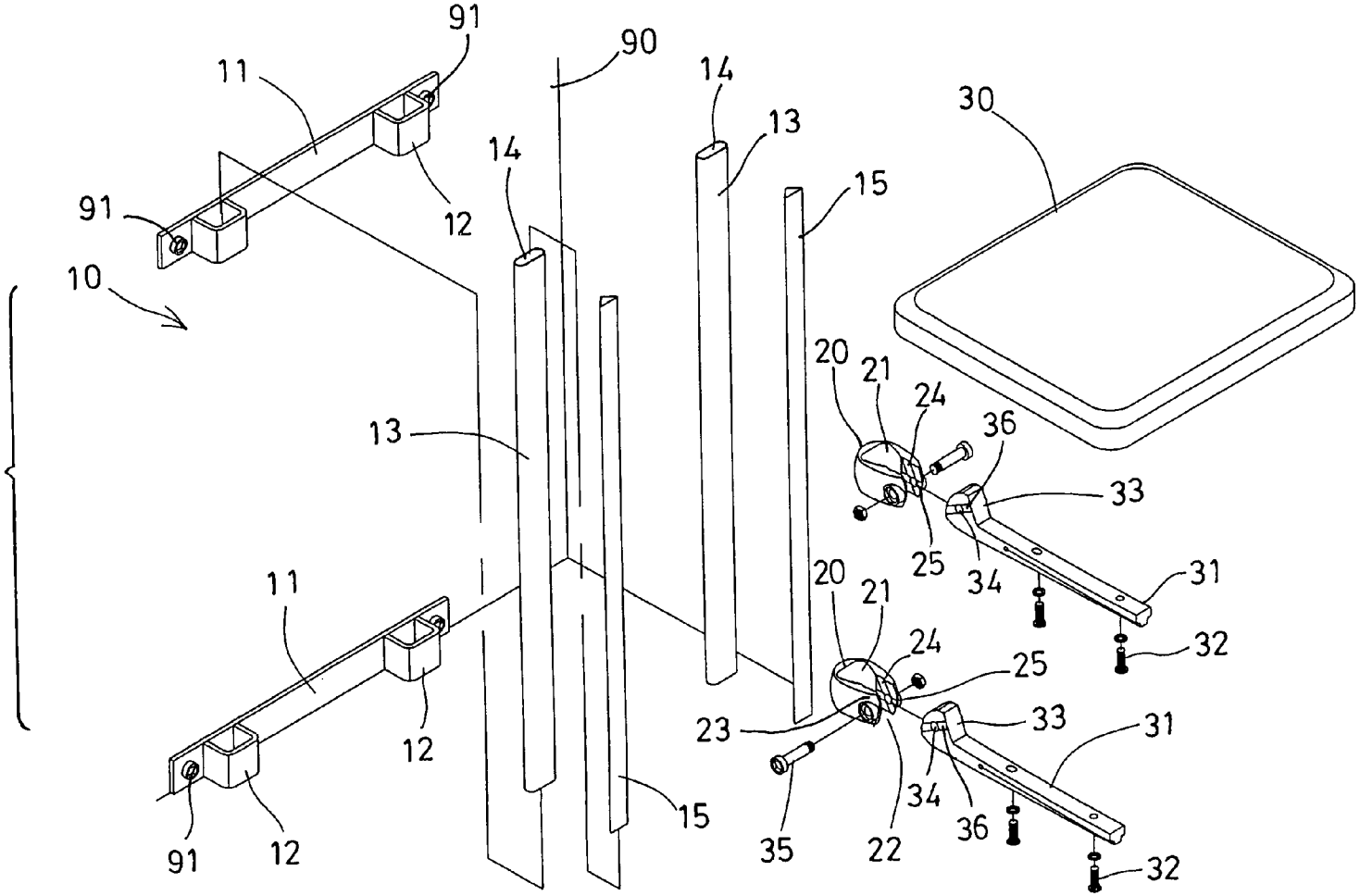
FIG. 2 is an exploded view of the chair for bathroom.

Referring to the drawings, and initially to FIG. a chair for bathroom in accordance with the present invention comprises a support 10 including two bars 11 secured onto a wall 90 of a bathroom with such as fasteners 91, and preferably spaced away from each other, and preferably disposed one above the other. Each of the bars 11 includes one or more, such as two frames 12 provided thereon or extended therefrom.

One or more, such as two rails 13 have upper and lower portions engaged into the frames 12, and secured to the frames 12 with such as fasteners, latches, (not shown) or by welding processes, for allowing the rails 13 to be vertically secured to the wall 90 of the bathroom with the frames 12 and the bars 11 of the support 10.

Each of the rails 13 preferably includes a hollow bore 14 formed therein, and includes an oval or olivary cross section, and further includes a beam 15 disposed or engaged therein, and preferably engaged with an inner peripheral surface of the rails 13 (FIGS. 1 and 3–6), to reinforce the rails 13, and to increase the bending strength of the rails 13. It is preferable that the beams 15 include a triangular cross section which includes a great bending strength.

One or more, such as two brackets 20 each includes a chamber 21 formed therein to slidably receive the rails 13 respectively, and thus to allow the brackets 20 to slide up and down along the rails 13 respectively. Each of the brackets 20 further includes an opening 22 formed therein and communicating with the chamber 21 thereof, and defined between two ears 23.

A seat plate 30 includes one or more, such as two stays 31 secured thereto, such as secured to the bottom portion thereof with fasteners 32, latches, or by welding processes, and includes one or more, such as two cams 33 provided thereon or extended therefrom, such as extended from the stays 31 respectively, and disposed in the opening 22 and between the ears 23 of the brackets 20.

For example, each of the cams 33 includes an aperture 34 formed therein for receiving a shaft 35 therein, and for rotatably securing the cams 33 to the ears 23 of the brackets 20 with the pivot shafts 35 respectively, and for allowing the seat plate 30 to be rotated relative to the brackets 20 and the support 10.

The cams 33 are arranged to engage with the rails 13, and to support the seat plate 30 in a substantially parallel or folding or storing position relative to the support 10 (FIGS. 5, 6), and also arrangeable to engage with the rails 13, and to support the seat plate 30 in a perpendicular or open or working position relative to the support 10 (FIGS. 3, 4), in order to support the users, such as the children, the elders, the patient, particularly the paralytic patients, etc.

Figure 3:
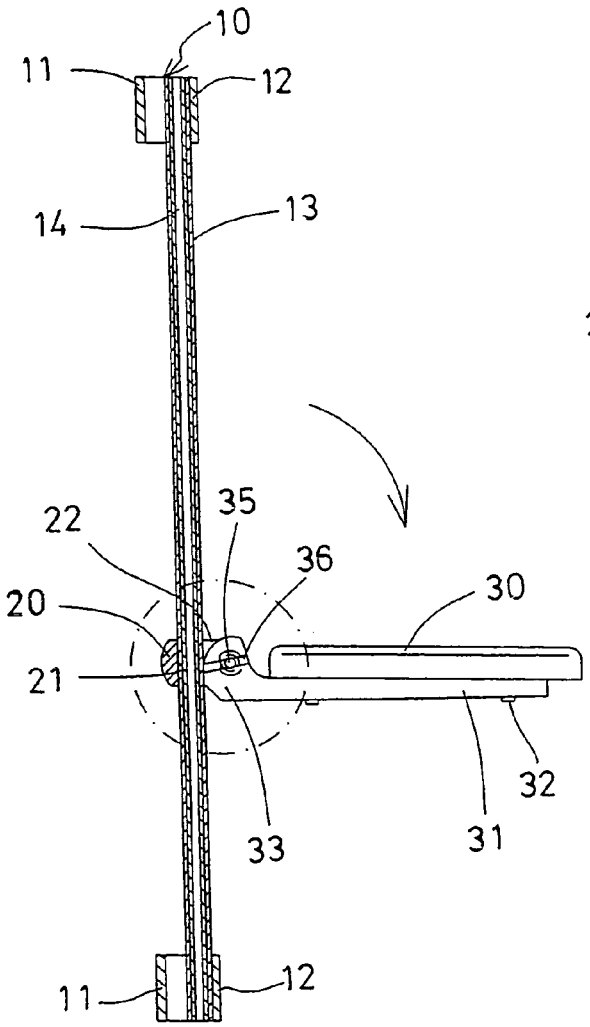
FIG. 3 is a partial cross sectional view taken along lines 3—3 of FIG. 1.
Figure 4:
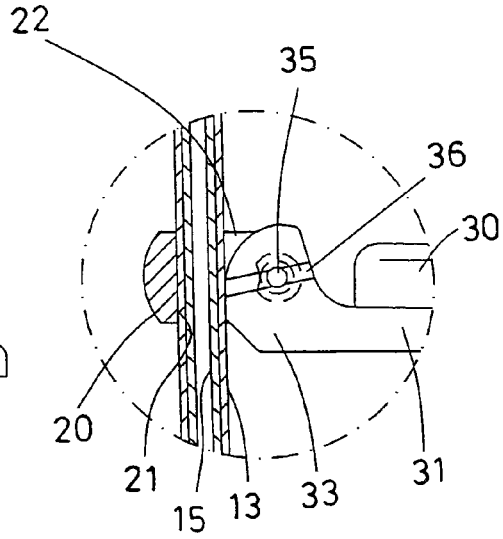
FIG. 4 is an enlarged partial cross sectional view of the chair for bathroom.

It is preferably that each of the brackets 20 includes one or more, such as two protrusions or recesses 24, 25 formed therein, and preferably inclined relative to each other, and each of the cams 33 includes a recess or a protrusion 36 extended therefrom and communicating with or intersecting with the apertures 34 thereof, for selectively engaging with the corresponding protrusions or recesses 24, 25 of the brackets 20, and to stably support the seat plate 30 in the parallel or folding or storing position relative to the support 10 (FIGS. 5, 6), or in the perpendicular or open or working position relative to the support 10 (FIGS. 3, 4).

In operation, as shown in FIGS. 3 and 4, when the seat plate 30 is rotated relative to the rails 13 to a position substantially perpendicular to the support 10, the cams 33 may be engaged with the rails 13 to support the seat plate 30 in the perpendicular or open or working position relative to the support 10, in order to stably support the users thereon, because the seat plate 30 may be stably secured or anchored to the support 10 with the cams 33, and because the seat plate 30 may not be moved or removed or disengaged from the support 10.

Figure 5:
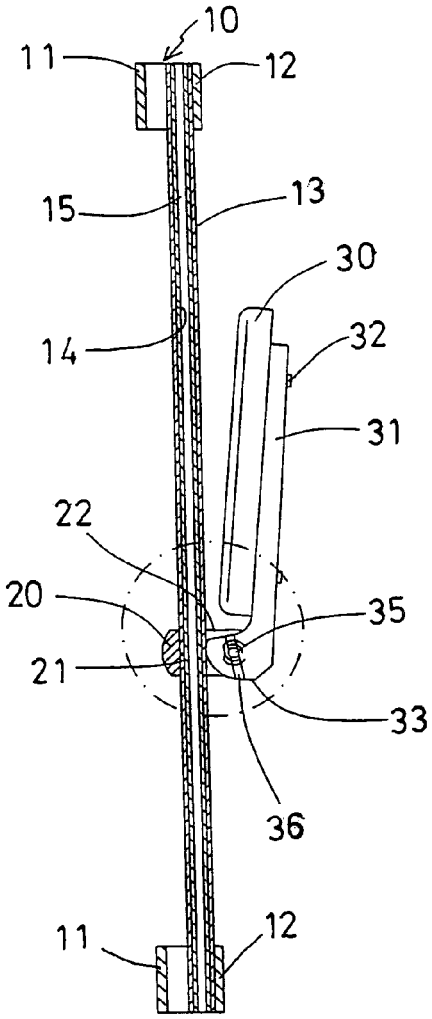
FIG. 5 is a partial cross sectional view similar to FIG. 3, illustrating the operation of the chair for bathroom.
Figure 6:
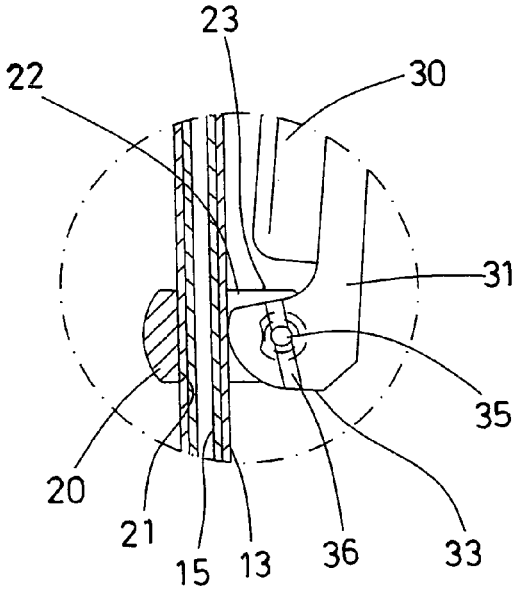
FIG. 6 is an enlarged partial cross sectional view similar to FIG. 4, illustrating the operation of the chair for bathroom.

After using, as shown in FIGS. 5 and 6, the seat plate 30 may also be rotated relative to the rails 13 to a position substantially parallel to the support 10, the cams 33 may also be engaged with the rails 13 to support the seat plate 30 in the parallel or folding or storing position relative to the support 10, for allowing the seat plate 30 to be folded and stored in a compact storing structure.

The selective engagement of the recesses or protrusions 36 of the cams 33 in the corresponding protrusions or recesses 24, 25 of the brackets 20 may further be provided to stably support the seat plate 30 in the parallel or folding or storing position relative to the support 10 (FIGS. 5, 6), or in the perpendicular or open or working position relative to the support 10 (FIGS. 3, 4). The provision or the engagement of the beam 15 in the hollow bores 14 of the rails 13 may further reinforce the rails 13, and to increase the bending strength of the rails 13, and to prevent the rails 13 from being bent by the brackets 20 and the seat plate 30.

Accordingly, the chair in accordance with the present invention may be provided for being used in a bathroom and having a foldable structure for allowing the chair to be easily folded to a compact storing or folded structure.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A chair for bathroom comprising:

a support for securing to a wall of the bathroom, said support including at least one rail vertically disposed thereon, at least one bracket including a chamber formed therein to slidably receive said at least one rail, and to allow said at least one bracket to slide up and down along said at least one rail, said at least one bracket including an opening formed therein and communicating with said chamber thereof, and defined between two ears, and including a first protrusion extended into said opening thereof, a seat plate including at least one cam provided thereon and disposed between said ears and in said opening of said at least one bracket, said at least one cam including an aperture formed therein, and a shaft engaged through said ears and said aperture of said at least one cam, to rotatably secure said at least one cam to said ears of said at least one bracket with said shaft, and to allow said seat plate to be rotated relative to said at least one bracket and said support, said at least one cam being arranged to engage with said at least one rail, and to support said seat plate in a folding and storing position when said seat plate is rotated relative to said at least one rail to a position parallel to said support, and said at least one cam also being arranged to engage with said at least one rail, and to support said seat plate in an open and working position when said seat plate is rotated relative to said at least one rail to a position perpendicular to said support, and said at least one cam including a recess formed therein and engageable with said first protrusion of said at least one bracket, to anchor said seat plate to said support in the open and working position relative to said support.

2. The chair as claimed in claim 1, wherein said seat plate includes at least one stay secured thereto, and having said at least one cam extended from said at least one stay.

3. The chair as claimed in claim 1, wherein said support includes two bars for securing to the wall of the bathroom, and said at least one rail is vertically secured between said bars.

4. The chair as claimed in claim 3, wherein said each of said bars includes at least one frame provided thereon, and said at least one rail includes upper and lower portions engaged into said at least one frame and secured to said at least one frame of said bars.

5. The chair as claimed in claim 1, wherein said at least one rail includes a hollow bore formed therein, and includes a beam disposed and engaged into said hollow bore of said at least one rail, to reinforce said at least one rail, and to increase a bending strength of said at least one rail.

6. The chair as claimed in claim 5, wherein said beam is engaged with an inner peripheral surface of said at least one rail, to reinforce said at least one rail.

7. The chair as claimed in claim 5, wherein said beam include a triangular cross section having a great bending strength.

8. The chair as claimed in claim 1, wherein said at least one rail includes an oval cross section.

9. A chair for bathroom comprising:

a support for securing to a wall of the bathroom, said support including at least one rail vertically disposed thereon, at least one bracket including a chamber formed therein to slidably receive said at least one rail, and to allow said at least one bracket to slide up and down along said at least one rail, said at least one bracket including an opening formed therein and communicating with said chamber thereof, and defined between two ears, and including a first recess formed therein, a seat plate including at least one cam provided thereon and disposed between said ears and in said opening of said at least one bracket, said at least one cam including an aperture formed therein, and a shaft engaged through said ears and said aperture of said at least one cam, to rotatably secure said at least one cam to said ears of said at least one bracket with said shaft, and to allow said seat plate to be rotated relative to said at least one bracket and said support, said at least one cam being arranged to engage with said at least one rail, and to support said seat plate in a folding and storing position when said seat plate is rotated relative to said at least one rail to a position parallel to said support, and said at least one cam also being arranged to engage with said at least one rail, and to support said seat plate in an open and working position when said seat plate is rotated relative to said at least one rail to a position perpendicular to said support, and said at least one cam including a protrusion extended therefrom and engageable with said first recess of said at least one bracket, and to anchor said seat plate to said support in the open and working position relative to said support.

10. The chair as claimed in claim 9, wherein said at least one bracket includes a second recess formed therein and inclined relative to said first recess thereof, and said protrusion of said at least one cam is engageable with said second recess of said at least one bracket, and to anchor said seat plate to said support in the folding and storing position relative to said support.

11. The chair as claimed in claim 1, wherein said at least one bracket includes a second protrusion extended therefrom and inclined relative to said first protrusion thereof, and said recess of said at least one cam is engageable with said second protrusion of said at least one bracket, and to anchor said seat plate to said support in the folding and storing position relative to said support.

* * * * *